US009220965B1

(12) United States Patent
Hochberg

(10) Patent No.: US 9,220,965 B1
(45) Date of Patent: Dec. 29, 2015

(54) ROLLED TEE BALL HOLDER

(71) Applicant: Seth Hochberg, Plainville, MA (US)

(72) Inventor: Seth Hochberg, Plainville, MA (US)

(73) Assignee: Franklin Sports Inc., Stoughton, MA (US)

( * ) Notice: Subject to any disclaimer, the term of this patent is extended or adjusted under 35 U.S.C. 154(b) by 39 days.

(21) Appl. No.: 14/192,496

(22) Filed: Feb. 27, 2014

(51) Int. Cl.
*A63B 71/00* (2006.01)
*A63B 69/00* (2006.01)

(52) U.S. Cl.
CPC ..... *A63B 69/0075* (2013.01); *A63B 69/0002* (2013.01); *A63B 2069/0008* (2013.01); *A63B 2210/50* (2013.01); *A63B 2243/0004* (2013.01); *A63B 2243/0016* (2013.01)

(58) Field of Classification Search
CPC ..... A63B 69/0002; A63B 69/0075; A63B 2210/50; A63B 2069/0008; A63B 2243/0016; A63B 2243/0004
USPC ..... 473/422, 417, 451
See application file for complete search history.

(56) References Cited

U.S. PATENT DOCUMENTS

| | | | | |
|---|---|---|---|---|
| 4,227,691 | A | 10/1980 | Lefebvre et al. | |
| 4,383,686 | A | 5/1983 | Cardieri | |
| 4,445,685 | A | 5/1984 | Cardieri | |
| 4,664,374 | A | 5/1987 | Groves | |
| 4,709,924 | A | 12/1987 | Wilson et al. | |
| 4,819,937 | A | 4/1989 | Gordon | |
| 4,886,267 | A | 12/1989 | Licciardi et al. | |
| 4,962,924 | A | 10/1990 | James | |
| 5,004,234 | A | 4/1991 | Hollis | |
| 5,388,823 | A | 2/1995 | Prieto | |
| D373,806 | S | 9/1996 | Bunnell | |
| 5,897,444 | A | 4/1999 | Hellyer | |
| D410,052 | S | 5/1999 | Davis et al. | |
| 5,916,045 | A | 6/1999 | Busch | |
| 6,099,418 | A | 8/2000 | Owen | |
| 6,238,307 | B1 | 5/2001 | Owen | |
| 6,358,163 | B1 | 3/2002 | Tanner | |
| 6,413,175 | B1 | 7/2002 | Mooney, Jr. | |
| 6,682,445 | B1 | 1/2004 | Tanner | |
| 6,884,185 | B2 | 4/2005 | Udwin et al. | |
| D514,638 | S | 2/2006 | deGrasse | |
| 7,063,632 | B2 | 6/2006 | Green | |
| 7,479,074 | B1 | 1/2009 | Pierce | |
| 7,641,573 | B2 | 1/2010 | Cech | |
| 7,744,496 | B2 | 6/2010 | Chisena | |
| D633,583 | S | 3/2011 | Guevara | |
| 8,734,274 | B1 * | 5/2014 | Hochberg | 473/417 |
| 2003/0036446 | A1 * | 2/2003 | Udwin et al. | 473/417 |
| 2006/0019773 | A1 * | 1/2006 | Newman | 473/417 |
| 2011/0183781 | A1 * | 7/2011 | Chiu | 473/417 |
| 2012/0172153 | A1 * | 7/2012 | Newman | 473/417 |
| 2013/0178313 | A1 * | 7/2013 | Meier et al. | 473/417 |
| 2014/0295999 | A1 * | 10/2014 | Robinson | 473/417 |
| 2014/0364255 | A1 * | 12/2014 | Nelson et al. | 473/417 |

* cited by examiner

*Primary Examiner* — Mitra Aryanpour
(74) *Attorney, Agent, or Firm* — Joseph B Bowman

(57) ABSTRACT

A tee ball stand with a ground engaging base, a perpendicular stanchion connected to the base, and a resiliently flexible ball holder mounted atop the stanchion. The ball holder is formed from sheeting material rolled into a frusto-conical shape and maintained in such shape on a tapered base fitting. The base fitting includes a longitudinal abutment edge to align the longitudinal edge of the sheeting material with respect to the base and radially projecting pegs which register with holes in the lower skirt of the sheeting material in order to maintain the sheeting material in the proper frusto-conical shape and to prevent separation from the base.

16 Claims, 7 Drawing Sheets

ROLLED TEE BALL HOLDER

CROSS-REFERENCE TO RELATED APPLICATIONS

This application has no related applications.

STATEMENT REGARDING FEDERALLY SPONSORED RESEARCH OR DEVELOPMENT

The inventions described and claimed in this application were not made under federally sponsored research and development.

BACKGROUND OF THE INVENTION

This invention relates to a tee ball stand with a rolled ball holder. More specifically, this invention relates to a tee ball stand with a resiliently collapsible, frusto-conically shaped ball holder.

Tee ball stands are characteristically used in the process of teaching young children to hit a ball with a bat. The typical tee ball stand comprises a ground engaging base which supports an adjustable vertical pole having a ball support cup on the upper end. A ball is placed on the support cup so a youngster can then strike at the stationary ball by swinging a bat instead of the more difficult task of attempting to hit a moving ball. With limited experience or limited coordination, the youngster may occasionally strike the cup or pole holding the ball, rather than the ball itself. This can be expected as part of the learning process. As a result, however, the tee ball stand is frequently tipped over or moved and has to be repositioned for the training session to continue. This can be a source of frustration and discouragement, as well as a safety concern, for the youngster and coach in the event of inadvertent contact with errant bat swings.

U.S. Pat. Nos. 4,227,691, 4,709,924, 4,819,937, 4,962,924, 5,004,234, 5,916,045, 6,099,418 and 6,884,185, as well as others, are characteristic of various tee ball practice devices having a base plate that rests flat on the ground to support some type of ball holding apparatus.

The ball support cup for most tee ball stands are of a molded construction and are somewhat rigid. This results in movement or tipping of the tee ball stand if the cup is struck by an errant blow of the bat. Accordingly, there have been prior art support cups proposed to more readily yield to a side force. One such solution is a ball holder as shown by Tanner in U.S. Pat. No. 6,358,163 formed of flexible sheeting rolled into a frusto-conical shape.

Tanner subsequently acknowledges, in his U.S. Pat. No. 6,682,445, that the ball holder of his earlier patent did not hold well during use and was subject to tearing. In the '445 patent, Tanner claims to have improved the ball holder of the '163 patent by eliminating the lacing required to hold the sheeting material in the frusto-conical strip and by wrapping the lower end of the sheeting material with an elastic wrap. In use, however, this construction has not been reliable. Although tears and ripping of the sheeting material is less common, failure of the material to retain its shape and to remain functionally assembled atop the upright pole have been problems. Indeed, in the '445 patent, Tanner suggests repair of the sheeting material 90 with pieces cut from truck tires and use of a bicycle inner tube for the elastic wrap 95.

Accordingly, a need remains in the field of sports for a tee ball stand with a resiliently flexible ball holder that can repeatedly return to a frusto-conical shape after be struck with a baseball bat. The primary objective of this invention is to meet these needs.

SUMMARY OF THE INVENTION

More specifically, an object of the invention is to provide a tee ball stand with a resiliently flexible, frusto-conically shaped ball holder which is sufficiently rigid to support a baseball in an upright position when not subjected to a side impact force but is also sufficiently flexible to readily deform from its frusto-conical shape when subjected to a side impact force and then return to its original frusto-conical shape.

Another object of the invention is to provide a tee ball stand of the character described and being extremely rugged and durable construction.

An additional object of the invention is to provide a tee ball stand of the character described having a frusto-conically shaped ball holder formed from flexible sheeting wrapped around a uniquely contoured base fitting which retains the sheeting in its original frusto-conical shape even after repeated blows of a baseball bat.

A further object of the invention is to provide a ball holder of the character described wherein the sheeting material is locked onto the base fitting to precisely maintain a frusto-conical shape.

In summary, an object of the invention is to provide a tee ball stand with a ground engaging base, a perpendicular stanchion connected to the base, and a resiliently flexible ball holder mounted atop the stanchion. The ball holder is formed from sheeting material rolled into a frusto-conical shape and maintained in such shape on a tapered base fitting. The base fitting includes a longitudinal abutment edge to align the longitudinal edge of the sheeting material with respect to the base and radially projecting pegs which register with holes in the lower skirt of the sheeting material in order to maintain the sheeting material in the proper frusto-conical shape and to prevent separation from the base.

Other and further objects of the invention, together with the features of novelty appurtenant thereto, will appear in the course of the detailed description of the drawings.

BRIEF DESCRIPTION OF THE DRAWINGS

In the following description of the drawings, in which like reference numerals are employed to indicate like parts in the various views.

DETAILED DESCRIPTION OF THE DRAWINGS

Figure 1:
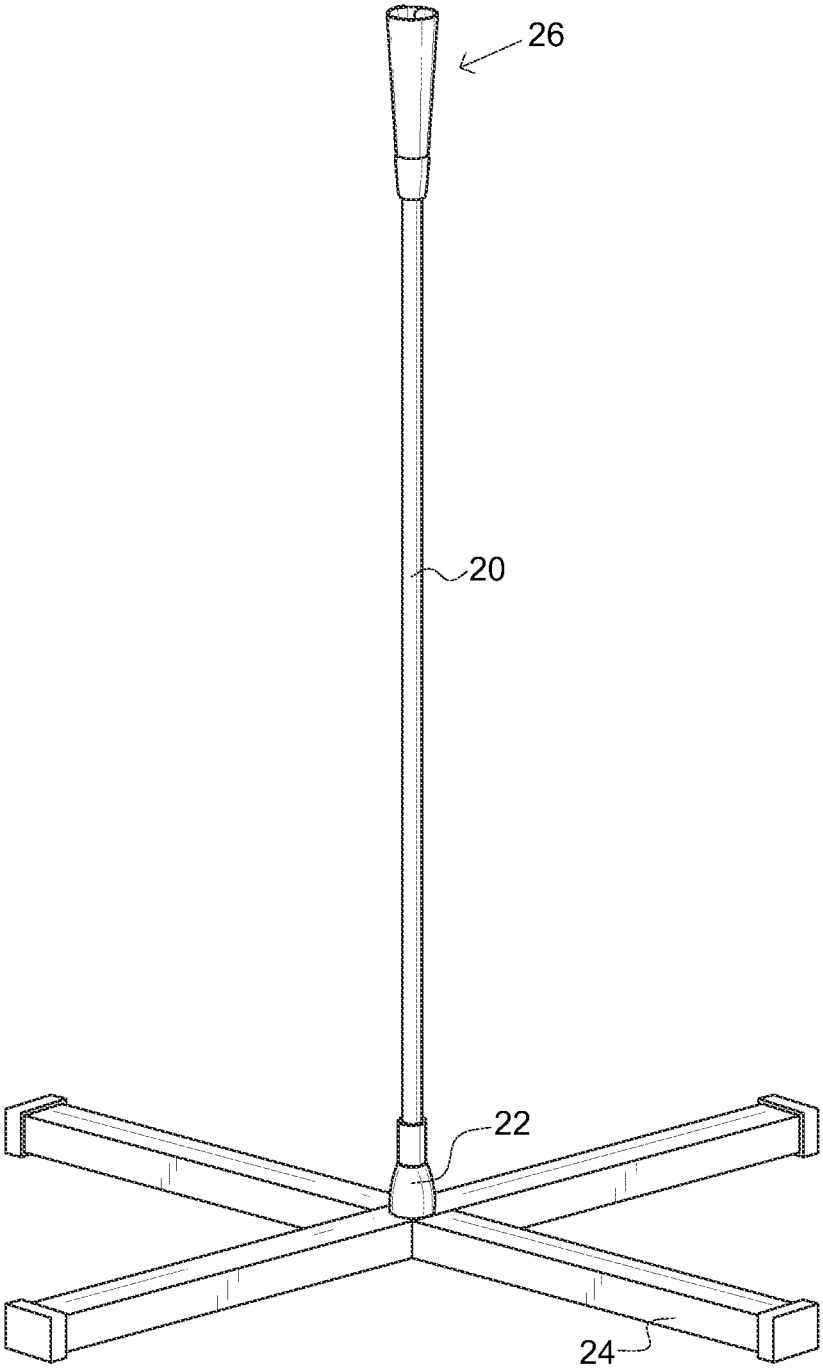
FIG. 1 is a perspective view of a tee ball stand with a rolled ball holder constructed in accordance with one embodiment of the invention.
Figure 2:
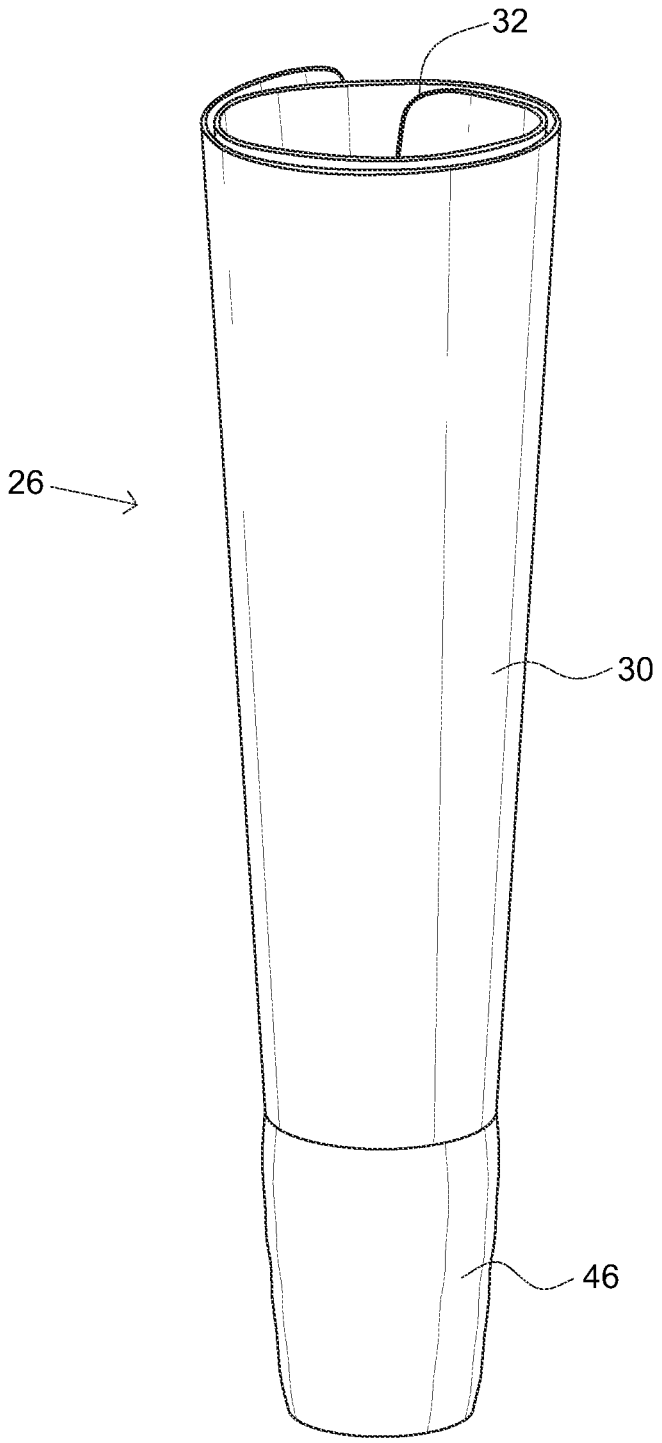
FIG. 2 is an enlarged perspective view of the ball holder.

Referring to the invention in greater detail, attention is first directed to FIG. 1. The tee ball stand includes an upright support stanchion, generally designated by the numeral 20, connected either permanently or removeably as by fitting 22 to a ground engaging base, generally designated by the numeral 24, to hold the stanchion 20 in a substantially vertical orientation perpendicular to the ground.

As those skilled in this art will appreciate, the stanchion 20 may be of a fixed or adjustably telescoping construction, and is preferably flexible. The base 24 likewise may have a variety of configurations, such as the X-frame as shown in FIG. 1 or a flat plate which many times is shaped like home plate of a baseball diamond.

Mounted atop the stanchion 20 is a ball holder, generally designated by the numeral 26. Further details of the ball holder 26 are illustrated in the remaining figures of the drawings.

Figure 3:
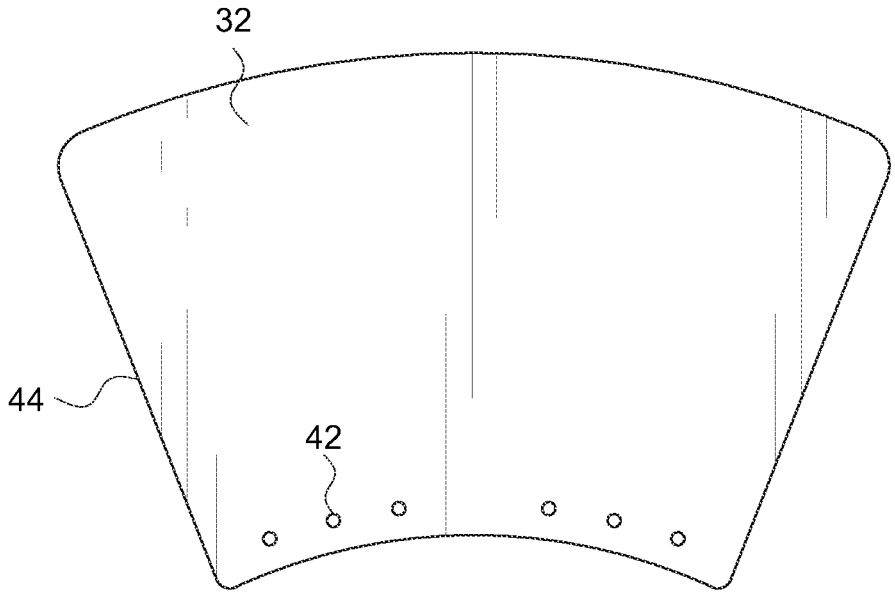
FIG. 3 is a planar view of the sheet material prior to being rolled to form the ball holder.

The ball holder 26 comprises a base fitting 28 and a frusto-conically shaped skirt 30 secured at the lower end thereof to the base fitting 28. The frusto-conically shaped skirt 30 is formed by rolling a piece of resiliently flexible sheeting material 32 as seen in FIG. 3 into a cone shape around the base fitting 28.

The sheeting material 32 may be rubber, silicon, or other flexible synthetic. It has a thickness preferably in the range of 1 to 3 millimeters. Approximately 2 laps of the sheeting material 32 are typically required to form the frusto-conical skirt 30 if the material thickness falls in the lower portion of the preferred range, but less than 2 laps of material can be used with thicker material. If less than 2 complete laps of material are employed, then it is important that the sides of the sheeting material 32 at least overlap one another throughout the height of the frusto-conical skirt 30.

Figure 6:
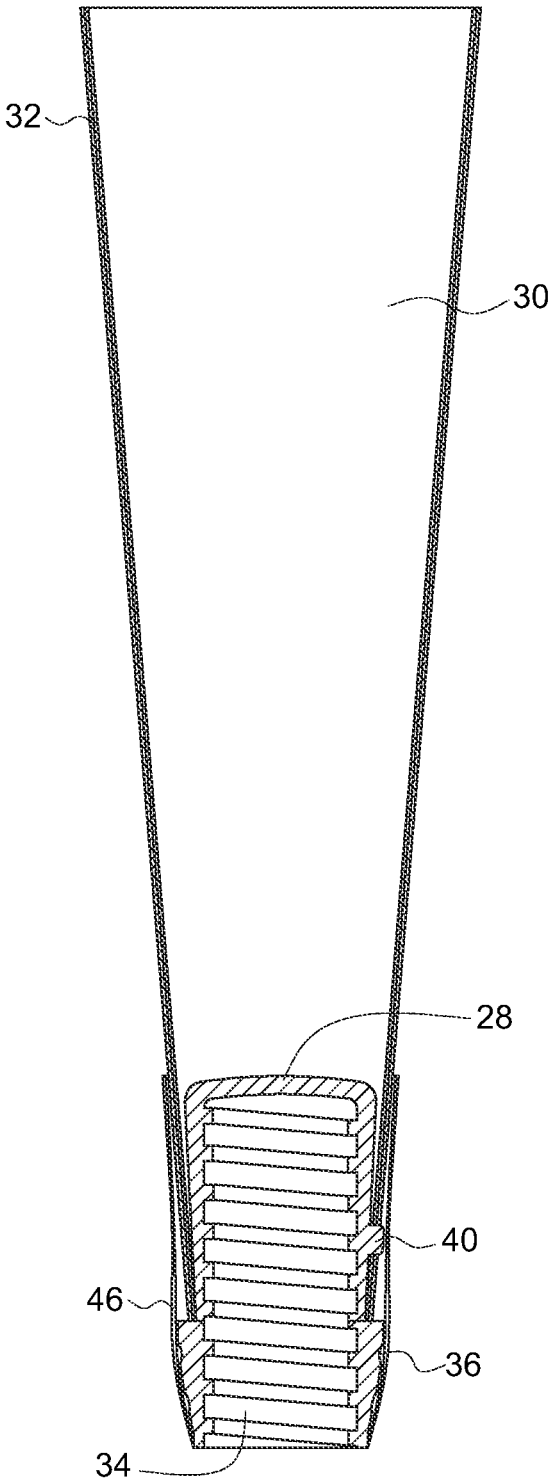
FIG. 6 is a side sectional view of the ball holder perspective view similar to FIG. 5 but showing the upright stanchion fully extending for use in batting practice.
Figure 7:
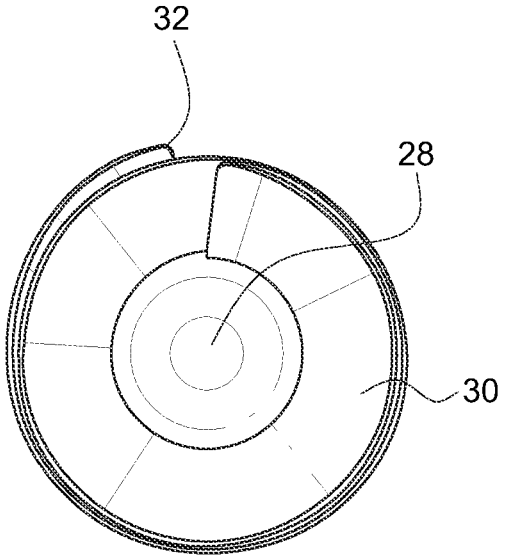
FIG. 7 is an end view taken along line 7-7 of FIG. 6 in the direction of the arrows.
Figure 8:
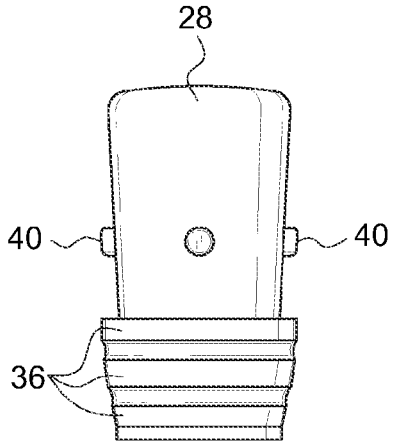
FIG. 8 is a front elevational view of the base fitting of the ball holder.

The base fitting 28, as shown in detail in FIGS. 6 & 8-11, has a uniquely contoured exterior. As seen in FIG. 6, the interior of the base fitting 28 is substantially hollow with an open bottom. Molded threads 34 within the interior mate with corresponding threads on the upper end of the stanchion 20 to removably connect the ball holder 26 to the stanchion 20. Alternatively, the base fitting 28 could be provided with a simple interior bore and be glued to the upper end of the stanchion to permanently attach the ball holder 26 to the stanchion 20.

Figure 9:
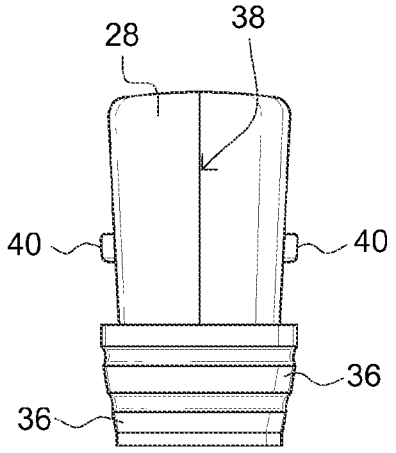
FIG. 9 is a rear elevational view of the base fitting of the ball holder.
Figure 10:
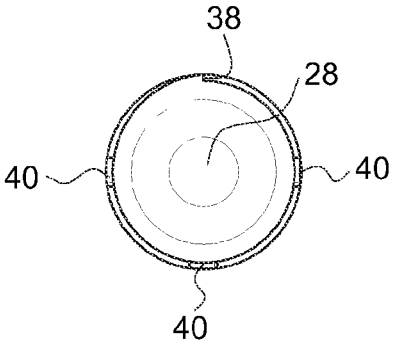
FIG. 10 is a top plan view of the base fitting of the ball holder taken along line 10-10 of FIG. 8 in the direction of the arrows.
Figure 11:
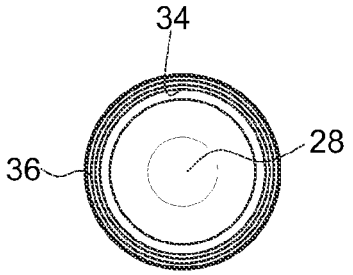
FIG. 11 is a bottom plan view of the base fitting of the ball holder taken along line 11-11 of FIG. 9 in the direction of the arrows.

The lower portion of the base fitting 28 has a downwardly sloping taper with gripping ridges 36 molded therein. The upper portion of the base fitting 28 has an upwardly sloping taper which, as will be seen, corresponds identically to the taper of the frusto-conical skirt 30. As shown in FIGS. 9 & 10, the upper portion of the base fitting 28 includes a longitudinal abutment edge or ridge 38 which substantially corresponds to the thickness of the sheeting material 32 to be wrapped around the base fitting 28. The abutment edge 38 is located a one radial quadrant of the base fitting 28. At the other three radial quadrants of the base fitting 28, circular bosses or pegs 40 project from the tapered exterior of the upper section of the base fitting 28. The pegs 40 are all located at a preselected height between the lower portion of the base fitting 28 and the top end thereof. Moreover, the pegs 40 extend outwardly from the tapered surface of the upper portion of the base fitting 28 a height at least equal to the thickness of said sheet material 32 and less than or equal to twice the thickness of said sheet material 32.

Figure 4:
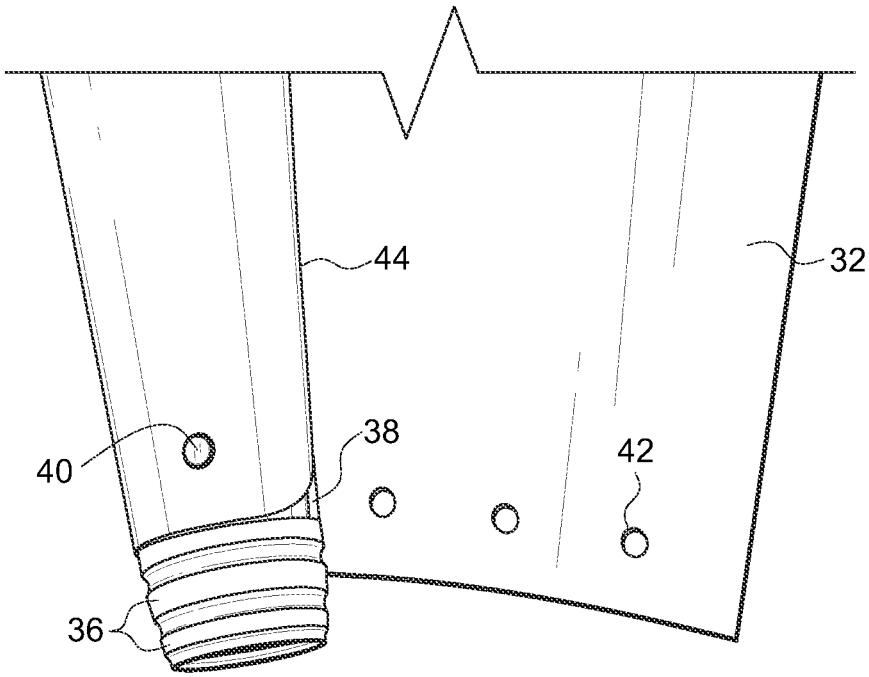
FIG. 4 is a fragmentary perspective of the lower end of the sheet material being rolled onto the base fitting of the ball holder.
Figure 5:
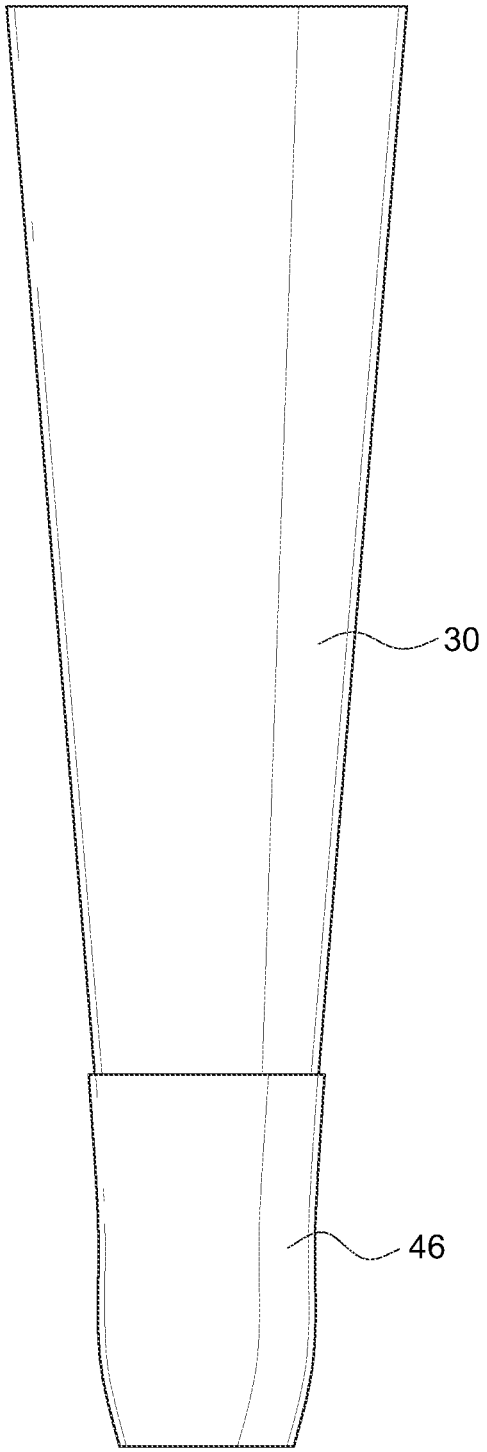
FIG. 5 is a side elevational view of the ball holder.

As shown in FIGS. 3 & 4, the lower end of the sheet material 32 includes two series of three holes 42. In forming the frusto-conical skirt 30, one side edge 44 of the sheeting material 32 is place against the abutment edge 38 on base fitting 28. This fixes the appropriate orientation of the sheeting material 32 with respect to the base fitting 28 in order to achieve the correct taper for the frusto-conical skirt 30. With the one side edge 44 of the sheeting material 32 against the abutment edge 38, the sheeting material 32 is wrapped around the base fitting 28 as shown in FIG. 4 with the first series of three holes 42 registering with and being extending over the pegs 40 to complete the first lap of sheeting material 32 around the base fitting 28. As the second lap of sheeting material 32 is wrapped around the base fitting 28, the second series of three holes 42 register with and extend over the pegs 40 in order to securely lock the sheeting material 32 to the base fitting 28 and complete the formation of the frusto-conical skirt 30.

With the sheeting material 32 wrapped around the base fitting 28 as described, a compression sleeve 46 may be slipped over the assembled base fitting 28 and lower end of the frusto-conical skirt 30 from below to encircle the base fitting 28 and engage the gripping ridges 38. Alternatively, the lower end of the sheeting material 32 can be glued or taped in order to retain the frusto-conical shape. It is important the upper section of the skirt 30 not be glued or taped, however, which would otherwise impair its flexibility and resiliency.

Assembled and constructed in the manner as described, rigid portion of the ball holder 26 as represented by the base fitting 28 and the lower section of the frusto-conical skirt 30 wrapped around the base fitting 28 comprises only about 15% to 25% of the overall height of the ball holder 26. Moreover, the frusto-conical skirt tapers from a smaller diameter at said lower end wrapped around the base fitting 28 to a larger diameter at the top which is 2 to 3 times greater than the smaller diameter. Accordingly, the greater portion of the ball holder 26 therefore comprises the upper section of the frusto-conical skirt 30 having sufficient stiffness to create a stable support for a baseball placed on top but still sideways flexible. The ball holder 26 constructed in the foregoing manner has very little influence on a properly struck ball. However, in the event the ball holder 26 is contacted by an errant swing of the bat, frusto-conical skirt 30 readily deflects and then returns to its original shape.

Even after repeated blows from a baseball bat, the ball holder 26 durably retains its usefulness and functionality and the frusto-conical skirt 30 maintains its proper shape and attachment to the base fitting 28 as a result of the interlocking engagement previously described.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

Having thus described my invention, I claim:

1. A tee ball stand comprising:

an upright, elongate stanchion having upper and lower ends and, when in use, having an intended orientation substantially perpendicular to the ground, a ground engaging base connected to said lower end of said stanchion to support said stanchion in an upright position substantially perpendicular to the ground; and a ball holder connected to said upper end of said stanchion, said ball holder including a lower base fitting removably connected to said upper end of said stanchion, and also including a substantially frusto-conical ball support member having upper and lower ends and being formed from a thin, rolled, and flexible sheet material with a uniform thickness where said lower end thereof is secured to said base fitting and said upper end thereof is adapted to support a sports ball;

said base fitting having top and bottom sections with said top section having an increasing taper around which is wrapped said lower end of said sheet material, and with said bottom section having an opening therein to receive said upper end of said stanchion;

said top section of said base fitting also including a longitudinal abutment edge on the surface of said taper to contact and align said lower end of said sheet material wrapped around said base fitting;

whereby said frusto-conical ball support member is sufficiently rigid to support a sports ball in an upright position when not subjected to a side impact force but is also sufficiently flexible to readily deform from its frusto-conical shape when subjected to a side impact force and then return to its original frusto-conical shape.

2. The tee ball stand as in claim 1, wherein the height of said abutment edge from the surface of said taper substantially equals the thickness of said sheet material.

3. The tee ball stand as in claim 1, said top section of said base fitting further including pegs extending from the surface of said taper and being evenly spaced radially from said longitudinal abutment edge, and said lower end of said sheet material including holes therein which register with and receive said pegs.

4. The tee ball stand as in claim 3, wherein the height of said pegs from the surface of said taper is at least equal to the thickness of said sheet material and less than or equal to twice the thickness of said sheet material.

5. The tee ball stand as in claim 1 including a compression sleeve overlying the lower end of said sheet material to secure said lower end of said sheet material to said base fitting.

6. The tee ball stand as in claim 1 wherein the lower end of said frusto-conical ball support member comprises from 15% to 25% of the height thereof.

7. The tee ball stand as in claim 1 wherein said frusto-conical ball support member tapers from a smaller diameter at said lower end thereof to a larger diameter at said upper end thereof such that the ratio of said larger diameter to said smaller diameter falls in the range of 2 to 3.

8. The tee ball stand as in claim 1 wherein the thickness of said sheet material falls in the range of 1 to 3 millimeters.

9. A ball holder for a tee ball stand with an upright stanchion perpendicularly supported by a ground engaging base, said ball holder comprising:

a lower base fitting removably connected to the upper end of said stanchion; and a substantially frusto-conical ball support member having upper and lower ends and being formed from a thin, rolled, and flexible sheet material with a uniform thickness where said lower end thereof is secured to said base fitting and said upper end thereof is adapted to support a sports ball;

said base fitting having top and bottom sections with said top section having an increasing taper around which is wrapped said lower end of said sheet material, and with said bottom section having an opening therein to receive said upper end of said stanchion;

said top section of said base fitting including a longitudinal abutment edge on the surface of said taper to contact and align said lower end of said sheet material wrapped around said base fitting;

whereby said frusto-conical ball support member is sufficiently rigid to support a sports ball in an upright position when not subjected to a side impact force but is also sufficiently flexible to readily deform from its frusto-conical shape when subjected to a side impact force and then return to its original frusto-conical shape.

10. The ball holder as in claim 9, wherein the height of said abutment edge from the surface of said taper substantially equals the thickness of said sheet material.

11. The ball holder as in claim 9, said top section of said base fitting further including pegs extending from the surface of said taper and being evenly spaced radially from said longitudinal abutment edge, and said lower end of said sheet material including holes therein which register with and receive said pegs.

12. The ball holder as in claim 11, wherein the height of said pegs from the surface of said taper is at least equal to the thickness of said sheet material and less than or equal to twice the thickness of said sheet material.

13. The ball holder as in claim 9 including a compression sleeve overlying the lower end of said sheet material to secure said lower end of said sheet material to said base fitting.

14. The ball holder as in claim 9 wherein the lower end of said frusto-conical ball support member comprises from 15% to 25% of the height thereof.

15. The ball holder as in claim 9 wherein said frusto-conical ball support member tapers from a smaller diameter at said lower end thereof to a larger diameter at said upper end thereof such that the ratio of said larger diameter to said smaller diameter falls in the range of 2 to 3.

16. The ball holder as in claim 9 wherein the thickness of said sheet material falls in the range of 1 to 3 millimeters.

* * * * *